United States Patent [19]

Wolf

[11] Patent Number: 4,836,476

[45] Date of Patent: Jun. 6, 1989

[54] DECANTING BASKET

[75] Inventor: Christoph Wolf, Therwil, Switzerland

[73] Assignee: Wolf Handels AG, Switzerland

[21] Appl. No.: 193,649

[22] PCT Filed: Sep. 18, 1987

[86] PCT No.: PCT/CH87/00119

§ 371 Date: Apr. 15, 1988

§ 102(e) Date: Apr. 15, 1988

[87] PCT Pub. No.: WO88/02231

PCT Pub. Date: Apr. 7, 1988

[30] Foreign Application Priority Data

Sep. 26, 1986 [CH] Switzerland ..... 3864/86

[51] Int. Cl.[4] ..... A47G 23/02

[52] U.S. Cl. ..... 248/146; 362/101; 362/802

[58] Field of Search ..... 248/542, 550, 105, 145.6, .248/146, 152, 174, 176, 311.2, 128, 133, 139, 140; 211/74; 220/85 H; 215/100 R; 222/113; 362/101, 96, 802, 154, 253

[56] References Cited

U.S. PATENT DOCUMENTS

| | | | |
|---|---|---|---|
| 2,177,337 | 10/1939 | Stein | 362/802 |
| 2,547,450 | 4/1951 | Du Pont | 362/96 |
| 2,663,866 | 12/1953 | Simpson | 362/101 |
| 2,819,860 | 1/1958 | Orbach | 248/128 |
| 3,184,587 | 5/1965 | Quijada | 362/96 |
| 3,349,235 | 10/1967 | Kolodziej | 362/802 |

FOREIGN PATENT DOCUMENTS

| | | |
|---|---|---|
| 1239113 | 7/1960 | France . |
| 1365446 | 5/1964 | France . |
| 317387 | 3/1957 | Switzerland . |

*Primary Examiner*—Alvin C. Chin-Shue
*Assistant Examiner*—Robert A. Olson
*Attorney, Agent, or Firm*—Toren, McGeady & Associates

[57] ABSTRACT

The decanting basket (1) comprises a holding bracket (6) adapted to hold an electrical battery (7), and an electrical source of light, namely an incandescent lamp (4). The latter is connected with the battery holding bracket (6) by way of a cable (5). The cable comprises an off-switch so positioned on the underside of the basket, to keep the circuit interrupted while the basket rests on a support surface, and to close the circuit as soon as the basket is lifted off its support surface, to have the incandescent lamp (4) transilluminate the neck of the bottle while the wine is poured out therefrom. This makes it simple to decant clear, clean wine, and to stop decanting as soon as a deposit appears in the neck.

3 Claims, 1 Drawing Sheet

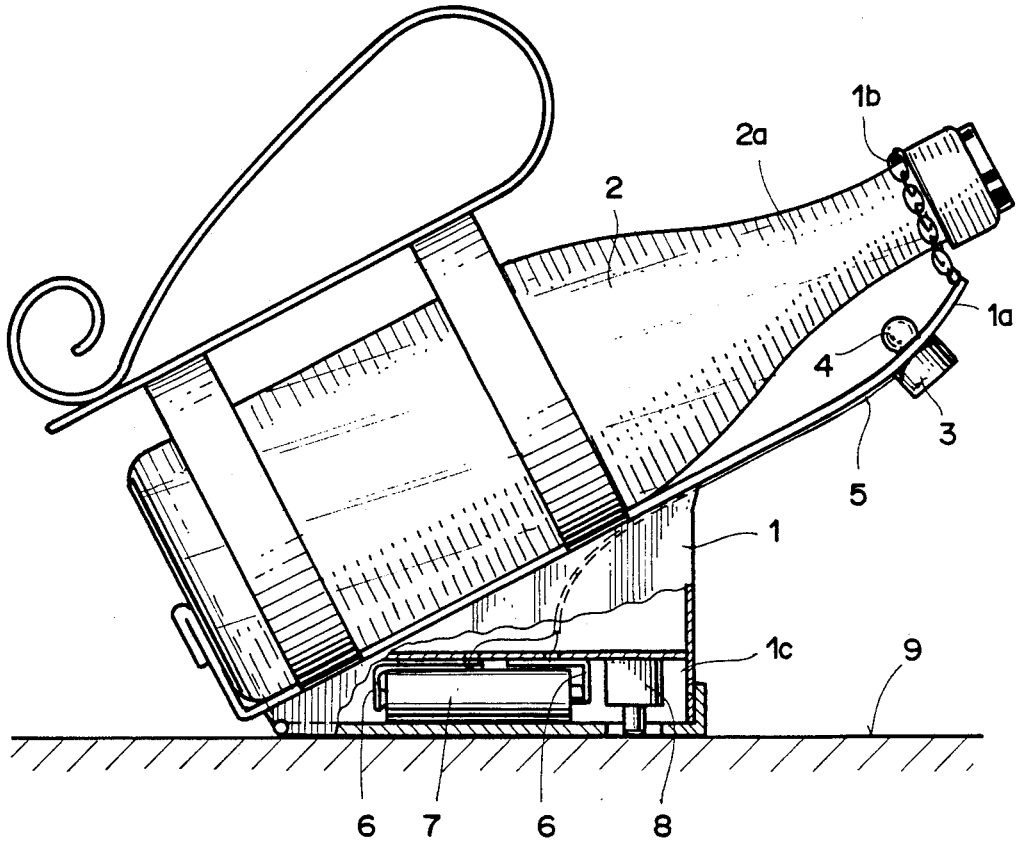
1b
2a
2
1a
4
3
5
1
1c
9
6
7
6
8

DECANTING BASKET

TECHNICAL FIELD OF THE INVENTION

The invention refers to a decanting basket.

STATE OF THE ART

When aged red wines are served from a wine bottle, the latter is frequently placed onto a so-called decanting basket. Such a decanting basket is also referred to as "Flaschenkorb" (bottle basket) or "Flaschenwiege" (bottle cradle), depending on the material it is made of and of the geographical region it is used in. A decanting basket of this kind is used in the decanting process proper, i.e. for transferring the bottle content into a decanter, or else for pouring the wine into a glass. In order to make sure that only clear wine is poured out of the bottle rather than any deposit that frequently accumulates in aged wines, it is customary to use candle light, over which the decanting basket is held in a way to insure that the neck of the bottle is well transilluminated, so as to make it easy to check whether the outflowing wine is still clear, or whether any deposits are moving toward the bottle orifice. However, a burning candle is not always practical to use, and using it for pouring wine into glasses is found to be—in most cases—so disturbing, that the use of the candle is dispensed with. Therefore, there remains the permanent risk, that deposits too, not only clear wine, will be poured out of the bottle.

SUMMARY OF THE INVENTION

The decanting basket of the invention offers the possibility to dispense with the use of candle light and to exert, nevertheless, control over the clearness of the wine flowing through the neck of the bottle. This decanting basket is namely characterized in that it comprises a holding bracket adapted to hold an electrical battery, and—in its region serving to accommodate the neck of the bottle—it also comprises an electrical light source connected by way of a switch with the battery holding bracket, the light source being adapted to transilluminate the neck of the bottle from the bottom upward, the switch being preferably an off-switch so positioned on the underside, to keep the circuit interrupted while the basket is in resting position, said light source being preferably arranged to comprise an incandescent lamp.

BRIEF DESCRIPTION OF THE DRAWING

An embodiment of the invention is described in the following, reference being made to the appended drawing. In the only FIGURE of the drawing is shown a decanting basket, certain parts of which are shown broken off or cut off.

A PREFERRED EMBODIMENT OF THE INVENTION

A basket, which may be made of any material, such as of wickerwork, bast, plastic, wood, or even metal, is designated as a whole by the reference numeral 1, and the bottle placed in the basket, by the reference numeral

2. The basket comprises a region 1*a* arranged to accommodate the bottle neck 2*a*, the assumption being made, that the bottle 2 is properly set in place. The chain 1*b* serves for securing the bottle against slipping out during the process of pouring. A lamp mounting bracket 3 is provided in the region 1*a* and arranged to comprise an electrical incandescent lamp 4 to serve as an electrical light source, the lamp 4 being connected by way of a cable 5 with the holding bracket 6 for the electrical battery 7, the holding bracket 6 being located, in the present case, at the base 1*c* of the basket 1. An off-switch 8 similarly located, in the present case, at the base 1*c* of the basket 1, serves for disconnecting the cable 5. This off-switch 8 is arranged to keep the cable 5 disconnected in the resting position of the basket. On the other hand, if the basket is lifted off its support 9, which may be the top plate of the table, then the lamp 4 becomes connected with the battery 7. The switch may, of course, be positioned into a different location, for example to provide for comfortable manual actuation. Alternately, the battery holding bracket may be positioned in some other place, depending on the design of the basket, as for example inside the basket, underneath the bottle.

The aforementioned embodiment provides for the lamp 4 to be extinguished as long as the basket rests on some support. The transillumination of the bottle neck 2*a* is switched-on if—and by the fact that—the basket is lifted off its support for the purpose of pouring out wine therefrom. In this way, the duration of the illumination is kept relatively short, the current consumption low, and the life of the battery very long. All of the disadvantages inherent in the use of a candle, such as the necessity of kindling it, extinguishing it, its heat generation, the bottle neck turning black, the danger of putting something afire or else to burn it, the difficulty to constantly hold the light source in the right position of the bottle neck to be controlled, fail to exist. Thus, the use of the decanting basket of the invention offers essential advantages when decanting, not only to the unskilled, but also to wine-lovers experienced in handling decanting baskets.

I claim:

1. Decanting basket, characterized in that it comprises a holding bracket (6) adapted to hold an electrical battery (7), and—in its region (1*a*) serving to accommodate the neck (2*a*) of the bottle—it also comprises an electrical light source (4) connected by way of a switch (8) with the battery holding bracket (6), the light source (4) being adapted to transilluminate the neck (2*a*) of the bottle from the bottom upward, wherein the switch is implemented as an off-switch so positioned to keep the circuit interrupted while the basket is in resting position.

2. Decanting basket as claimed in claim 1, characterized in that the light source is arranged to comprise an incandescent lamp (4).

3. Decanting basket as claimed in claim 1, wherein the off switch is positioned on the underside of the basket.

* * * * *